US006334541B1

(12) United States Patent
Chang

(10) Patent No.: US 6,334,541 B1
(45) Date of Patent: Jan. 1, 2002

(54) WASHROOM RACK FOR HOLDING AN OBJECT

(76) Inventor: Tien-Tsai Chang, No. 18, Lane 1281, Chung Cheng Road, Wu Fong Hsiang, Taichung Hsien (TW)

( * ) Notice: Subject to any disclaimer, the term of this patent is extended or adjusted under 35 U.S.C. 154(b) by 0 days.

(21) Appl. No.: 09/492,874

(22) Filed: Jan. 26, 2000

(51) Int. Cl.[7] ..... A47F 5/08

(52) U.S. Cl. ..... 211/88.01; 211/16; 211/133.3; 248/214

(58) Field of Search ..... 211/105.1, 87.01, 211/88.01, 123, 88.04, 85.12, 16, 182, 133.3; 248/214, 251, 298.1, 210, 238, 410; 220/475, 481, 476, 480; 206/557; D6/524, 527, 532, 533, 536, 540, 546, 549, 550; D7/552.1

(56) References Cited

U.S. PATENT DOCUMENTS 676,619 A * 6/1901 Faethe
D145,934 S * 11/1946 Gerity, Jr.
D189,838 S * 3/1961 Larson et al.
2,979,155 A * 4/1961 Scharfenberger
3,233,744 A * 2/1966 Ripps
3,307,710 A * 3/1967 Negri
4,036,463 A * 7/1977 Hopkins et al. ..... 211/71.01
D246,405 S * 11/1977 Richards
D248,906 S * 8/1978 Johnson et al.
4,233,911 A * 11/1980 Vignale ..... 211/88.01
4,541,131 A * 9/1985 Sussman ..... 211/113
4,662,594 A * 5/1987 Dubis
4,854,456 A * 8/1989 Lee ..... 211/88.01
4,870,907 A * 10/1989 McKee ..... 211/88.01
4,978,510 A * 12/1990 Smith ..... 206/439
4,991,724 A * 2/1991 Wei ..... 211/87.01
5,197,703 A * 3/1993 Pratolongo ..... 211/88.01
5,310,148 A * 5/1994 Dorr ..... 248/247
5,398,824 A * 3/1995 Wolff et al. ..... 211/87.01
5,429,252 A * 7/1995 Liu ..... 211/94.01
5,433,152 A * 7/1995 Henry ..... 248/214
D385,140 S * 10/1997 Whitehead et al. ..... 211/134
5,871,105 A * 2/1999 Whitehead et al. ..... 248/215
5,873,311 A * 2/1999 Schlattl ..... 248/298.1
D407,248 S * 3/1999 Scholpp ..... 211/126.1

* cited by examiner

*Primary Examiner*—Daniel P. Stodola
*Assistant Examiner*—Jennifer E. Novosad
(74) *Attorney, Agent, or Firm*—W. Wayne Liauh

(57) ABSTRACT

A washroom rack which can also be used to hold an object such as soap. It includes: (a) a plurality of support frames adapted to be fastened onto a wall; (b) a plurality of support rods mounted on the support frames; and (c) a tray provided in one side wall thereof with a plurality of blind holes. Each of the blind hole is defined by an open end and a closed end and fastened to one end of the support rod. The tray is provided in a bottom thereof with a plurality of threaded holes corresponding in location to the blind holes such that the tray is fastened to the support rods by a plurality of fastening bolts engaged with the threaded holes.

2 Claims, 8 Drawing Sheets

WASHROOM RACK FOR HOLDING AN OBJECT

FIELD OF THE INVENTION

The present invention relates generally to a rack, and more particularly to a rack which is simple in construction and can be easily installed.

BACKGROUND OF THE INVENTION

As illustrated in FIGS. 1 and 2, a washroom rack of the prior art is attached to the wall of the washroom for holding a soap. The prior art washroom rack can not be securely attached to wall and is thus apt to become detached from the washroom wall.

SUMMARY OF THE INVENTION

The primary objective of the present invention is to provide a rack comprising a plurality of support rods and support frames, and a tray. The support frames are attached securely to the wall of a room for supporting the support rods. The tray is held by the support rods. The rack is designed to hold a plurality of articles such as towels, soap, etc. The tray is used to hold the soap. The support rods are used to hold the tray as well as the towels.

The features, functions, and advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
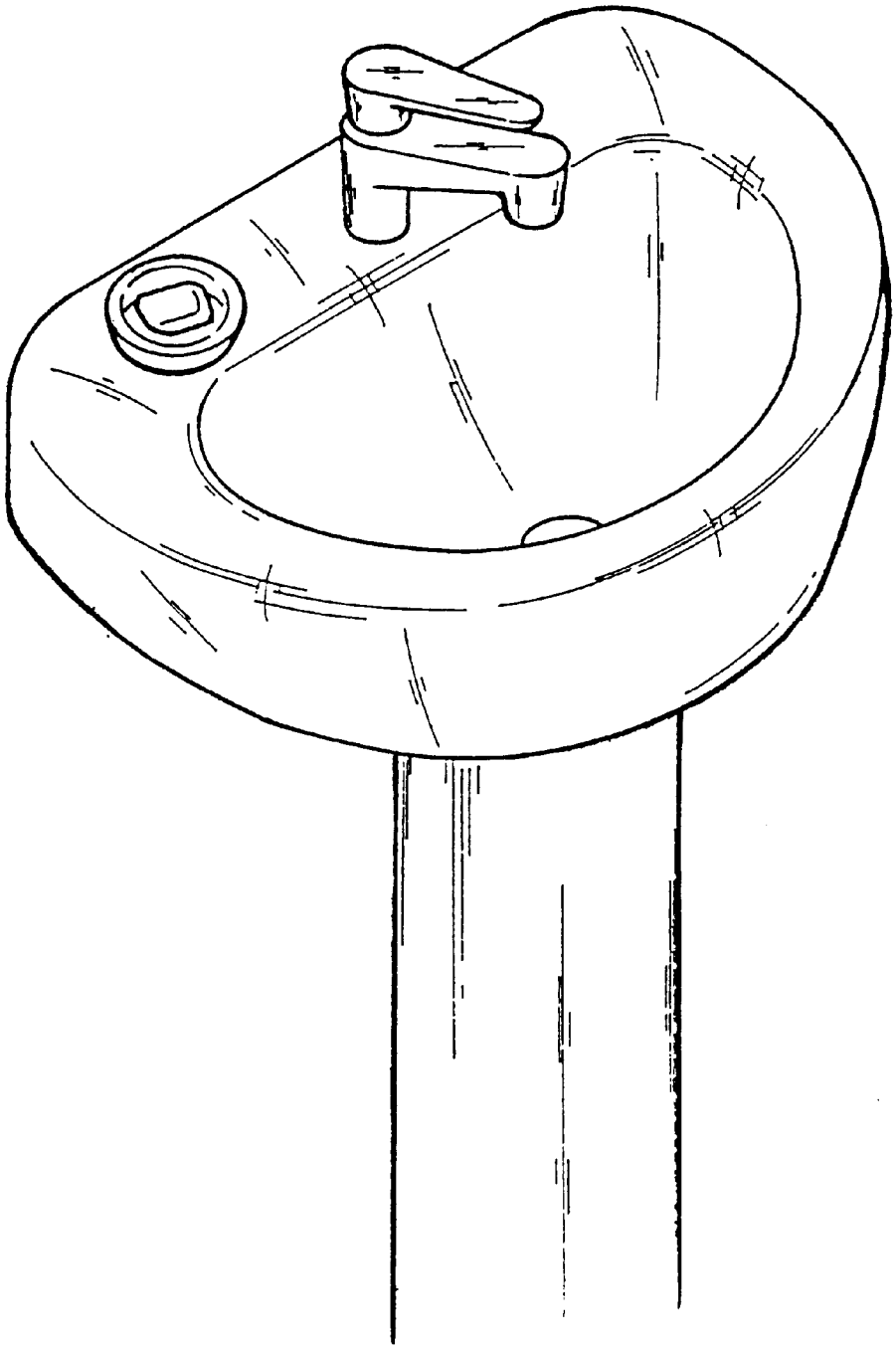
FIG. 1 PRIOR ART
FIG. 1 shows a schematic view of a washroom rack of the prior art.
Figure 2:
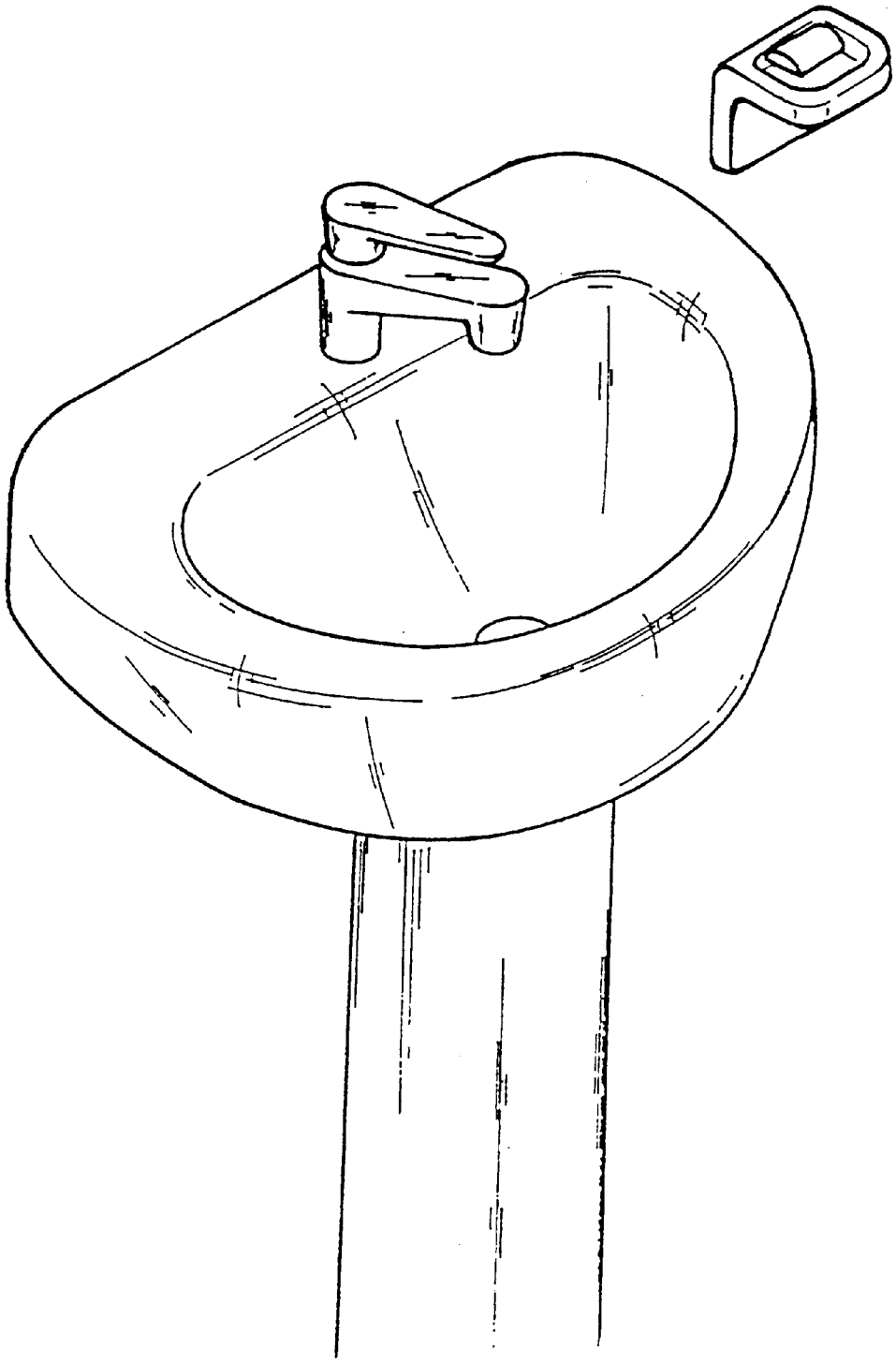
FIG. 2 PRIOR ART
FIG. 2 shows a schematic view of another prior art washroom rack.
Figure 3:
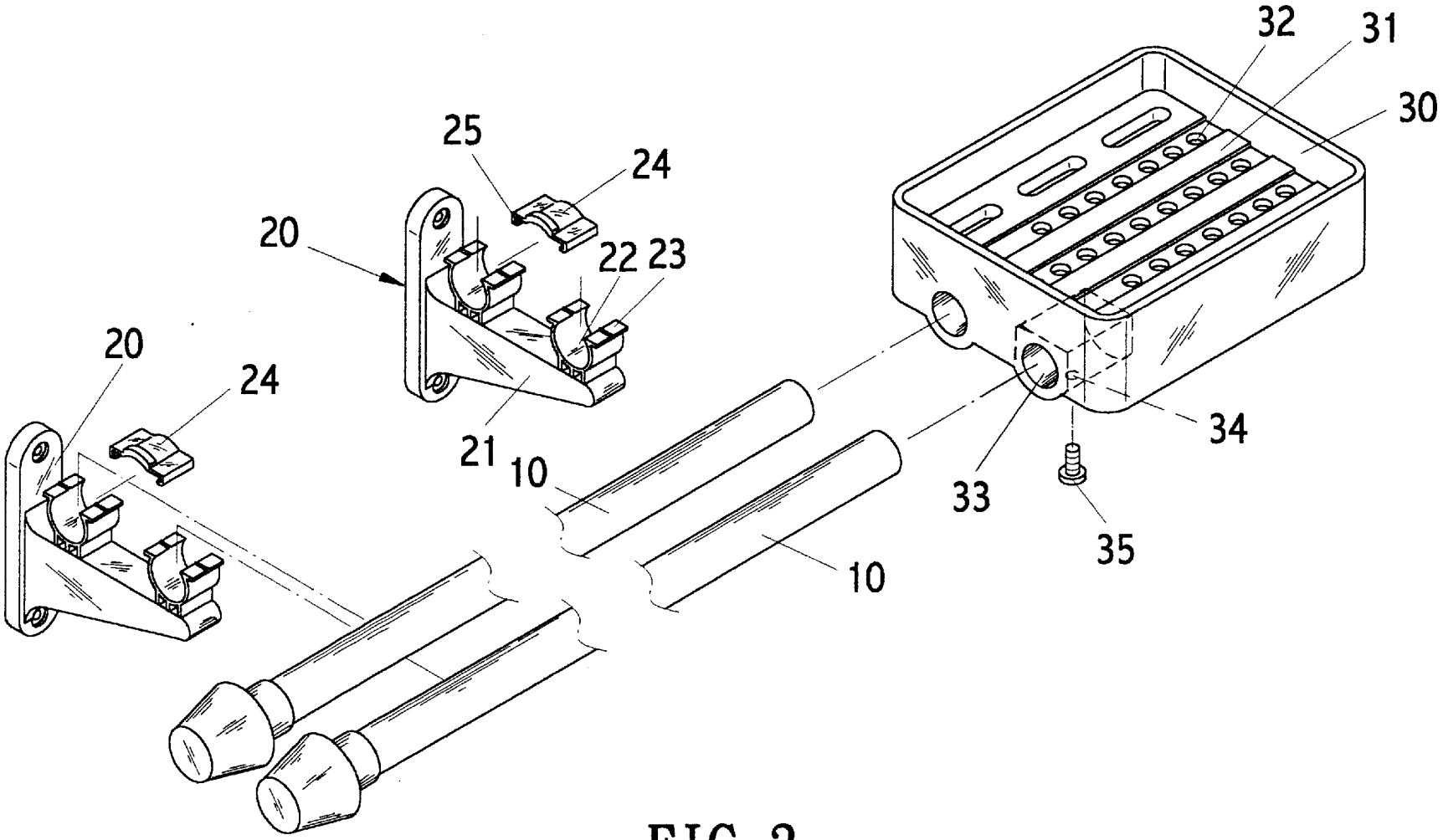
FIG. 3 shows an exploded view of a first preferred embodiment of the present invention.
Figure 4:
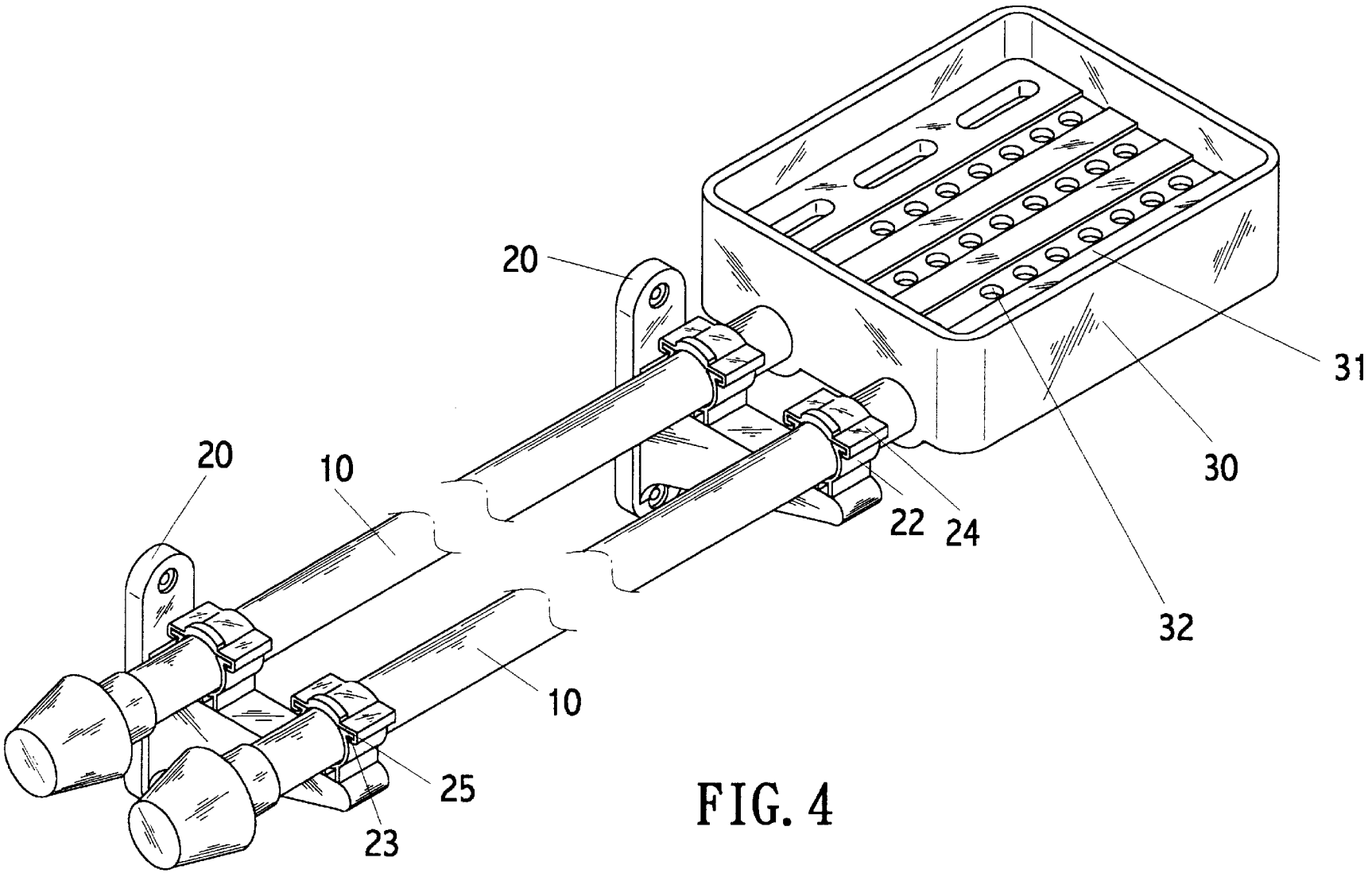
FIG. 4 shows a schematic view of the first preferred embodiment of the present invention in combination.
Figure 5:
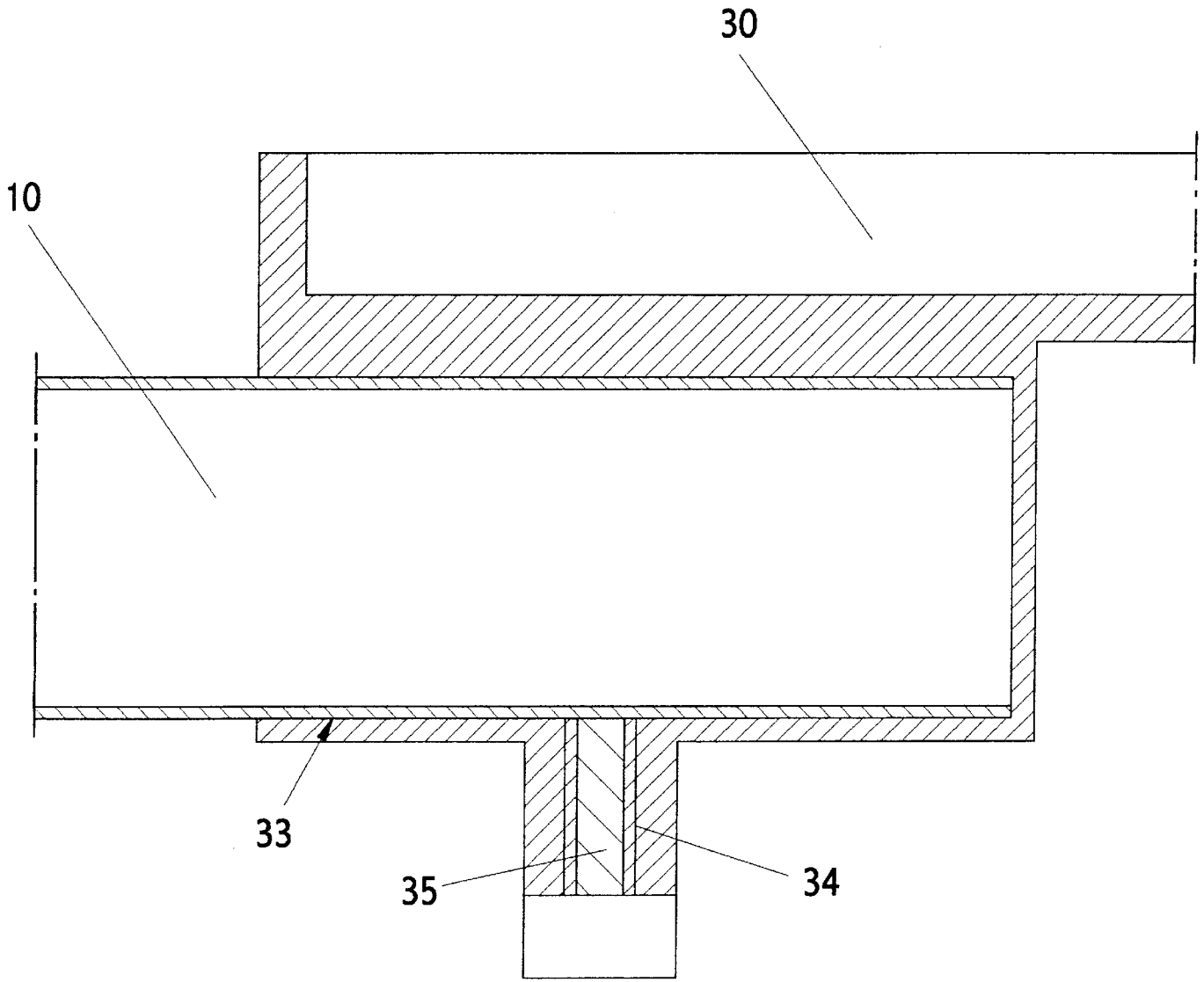
FIG. 5 shows a partial sectional view of the first preferred embodiment of the present invention.
Figure 6:
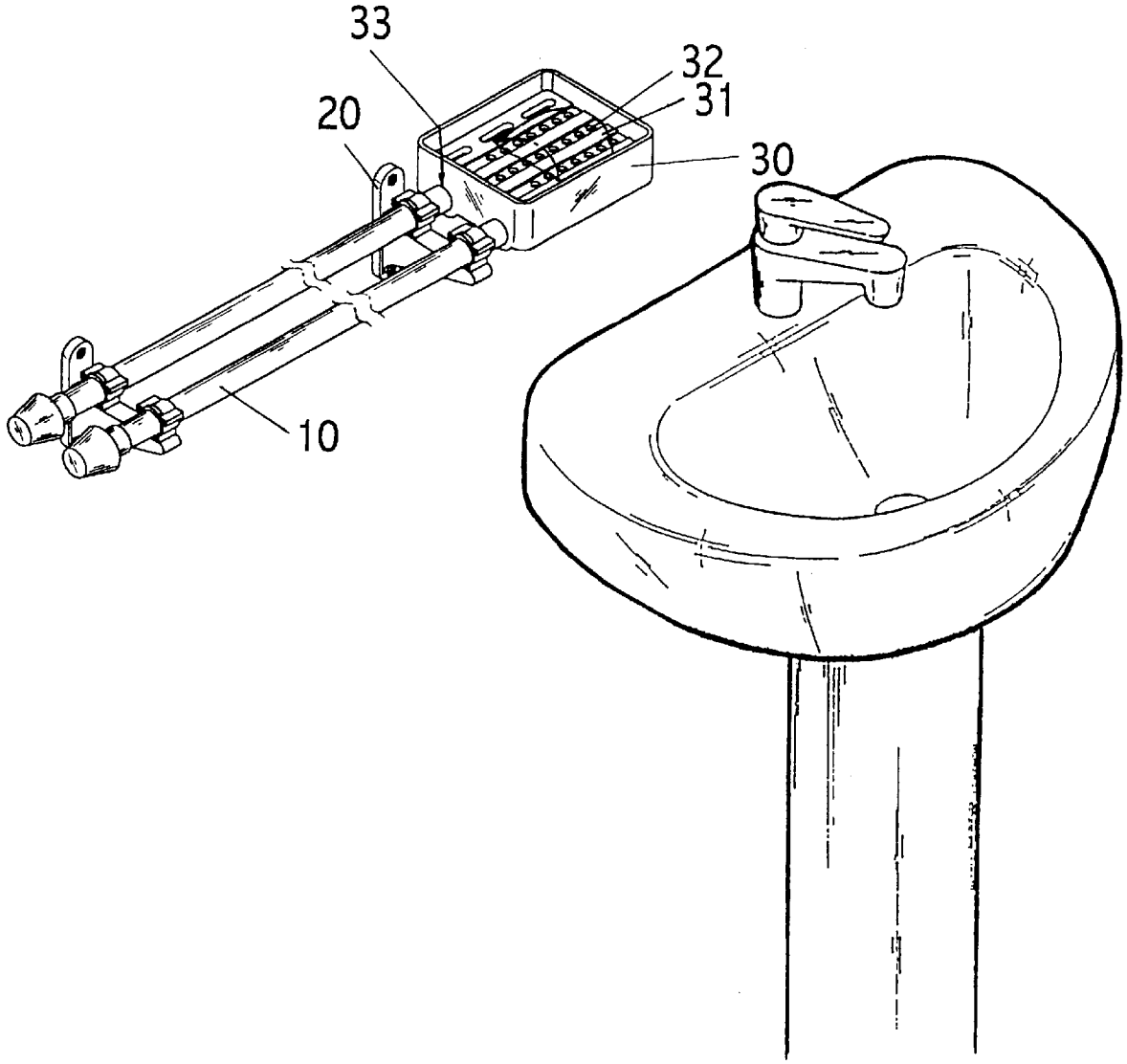
FIG. 6 shows a schematic view of the first preferred embodiment of the present invention in use.

As shown in FIGS. 3–6, a washroom rack embodied in the present invention is formed of two support rods 10, two support frames 20, and a tray 30. The two support frames 20 are attached to the wall of a washroom such that the two support frames 20 are separated from each other by a distance. The two support frames 20 are provided with a protrusion 21, which is in turn provided on the upper surface thereof with two locating members 22, with each having two slide blocks 23 engageable with two slide slots 25 of two cover pieces 24. The two support rods 10 are supported by the two support frames 20 such that the support rods 20 are located by the locating members 22. The tray 30 is fastened with one end of each of the two support rods 20 by a plurality of fastening bolts 35 which are engaged with the threaded holes 34 of the bottom of the tray 30. The tray 30 is provided in one side wall thereof with two blind holes 33 for receiving the support rods 20. The tray 30 is provided with a holding surface 31 which is provided with a plurality of through holes 32. The tray 30 is intended for use in holding a soap, which is placed on the holding surface 31. The through holes 32 of the holding surface 31 are intended to keep the soap dry. In the meantime, the support rods 20 are used to hold the towels.

Figure 7:
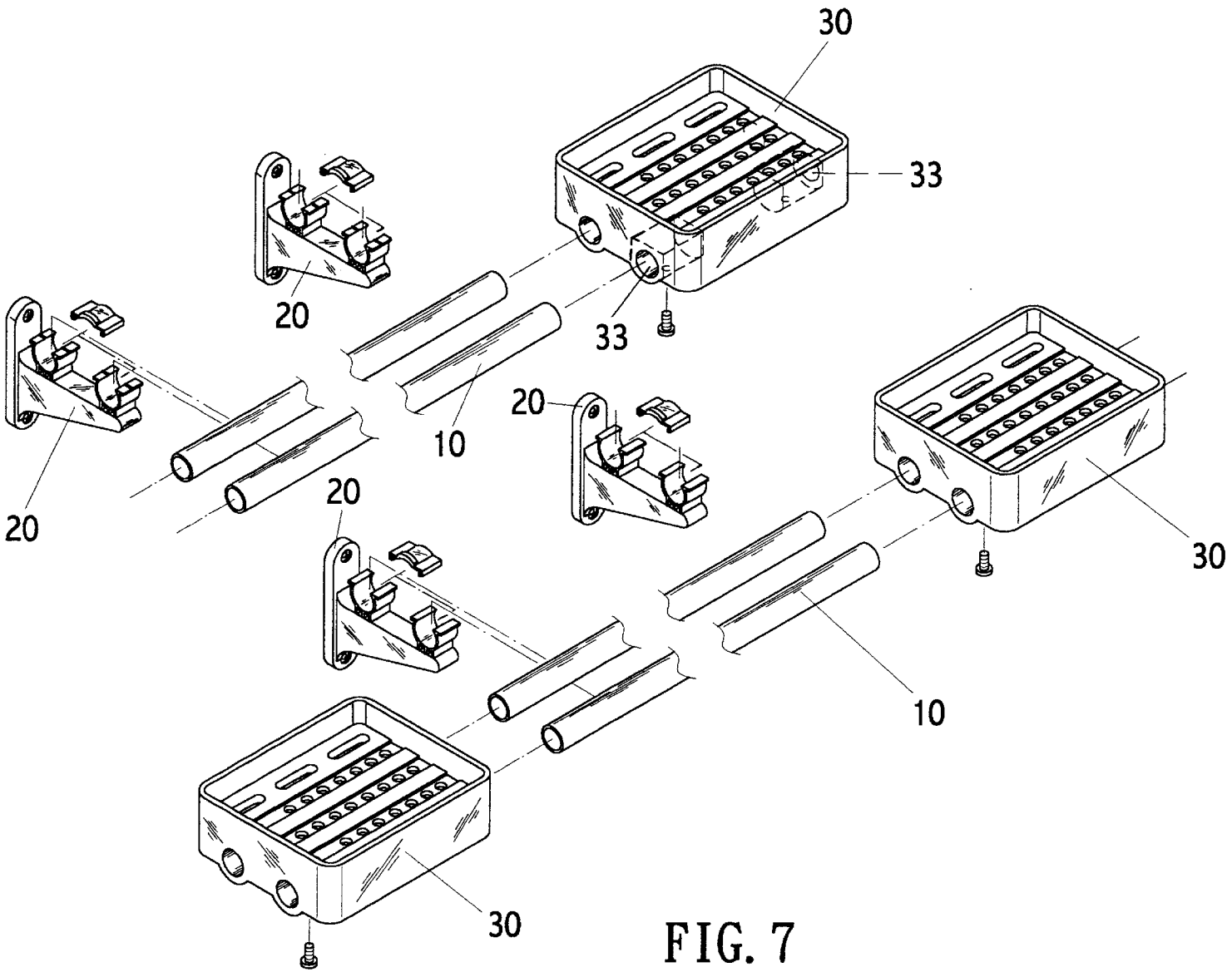
FIG. 7 shows an exploded view of a second preferred embodiment of the present invention.
Figure 8:
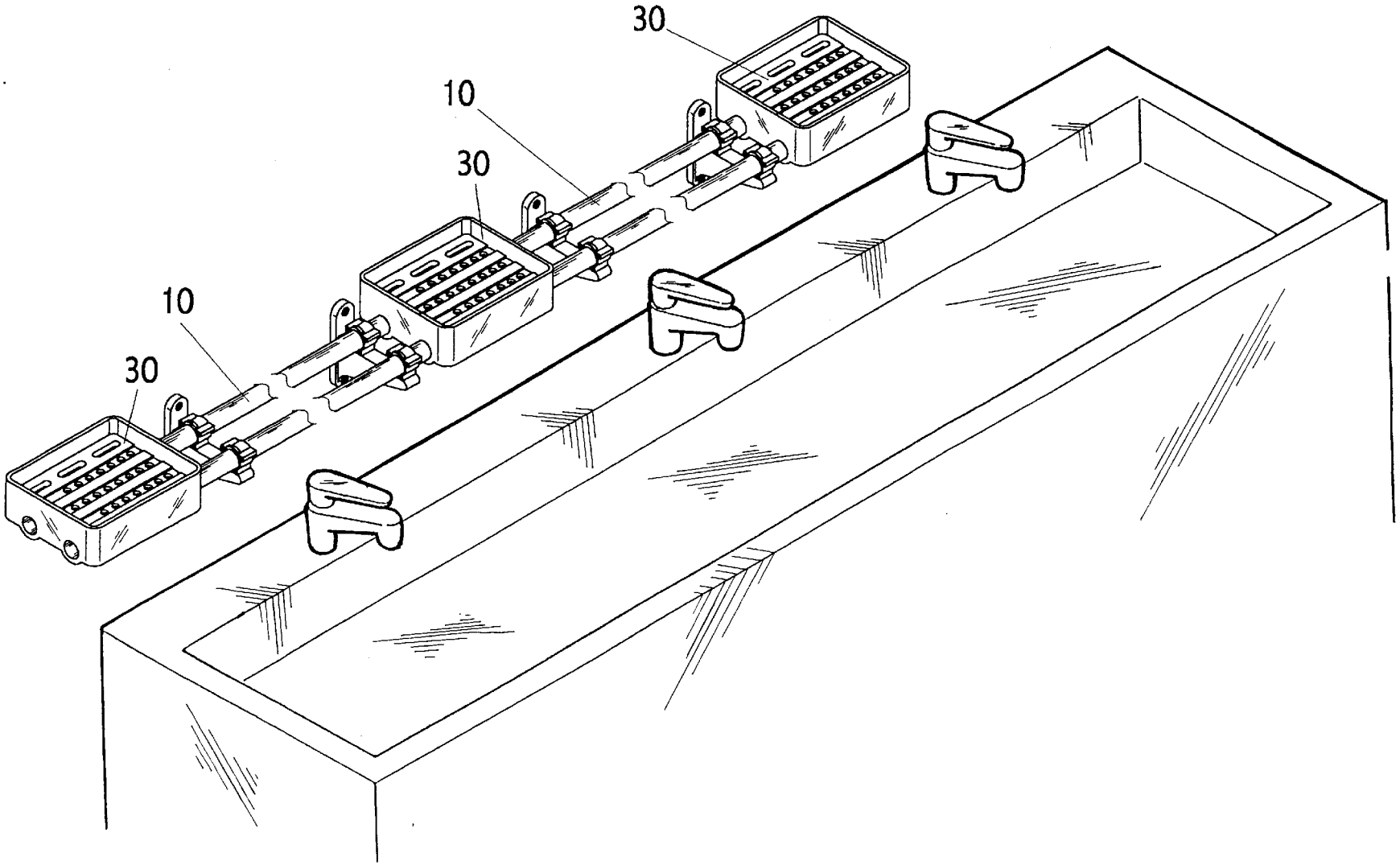
FIG. 8 shows a schematic view of the second preferred embodiment of the present invention in use.

As shown in FIGS. 7 and 8, a plurality of the rack units of the present invention are used in such a way that they are joined together end to end.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed:

1. A rack comprising:

a plurality of support frames adapted to be fastened onto a wall;

a plurality of support rods mounted on said support frames; and a tray provided in one side wall thereof with a plurality of blind holes, each being defined by an open end and a closed end and fastened to one end of said support rods, said tray further being provided therein with a holding surface for holding an article;

wherein said tray is provided in a bottom thereof with a plurality of threaded holes corresponding in location to said blind holes such that said tray is fastened to said support rods by a plurality of fastening bolts engaged with said threaded holes.

2. The rack as defined in claim 1, wherein said holding surface of said tray is provided with a plurality of through holes.

* * * * *